US009140518B2

(12) United States Patent
Tseng

(10) Patent No.: US 9,140,518 B2
(45) Date of Patent: Sep. 22, 2015

(54) AIR CANISTER FOR AIR GUN

(71) Applicant: Jui-Fu Tseng, Yilan (TW)

(72) Inventor: Jui-Fu Tseng, Yilan (TW)

( * ) Notice: Subject to any disclaimer, the term of this patent is extended or adjusted under 35 U.S.C. 154(b) by 0 days.

(21) Appl. No.: 14/564,117

(22) Filed: Dec. 9, 2014

(65) Prior Publication Data

US 2015/0090243 A1 Apr. 2, 2015

(51) Int. Cl.

| | |
|---|---|
| ***F41B 11/62*** | (2013.01) |
| ***F17C 13/04*** | (2006.01) |
| ***F17C 13/08*** | (2006.01) |

(52) U.S. Cl.

CPC ..... *F41B 11/62* (2013.01); *F17C 13/04* (2013.01); *F17C 13/084* (2013.01)

(58) Field of Classification Search

CPC ..... F41B 11/00; F41B 11/56; F41B 11/60; F41B 11/62; F41B 11/74; F17C 13/04; F17C 13/084

USPC ..... 124/69, 70, 71, 73, 74; 137/454.5, 137/384.6; 222/171, 161, 320, 232, 336; 141/250, 251, 258, 260

See application file for complete search history.

(56) References Cited

U.S. PATENT DOCUMENTS

| | | | | |
|---|---|---|---|---|
| 5,613,483 | A * | 3/1997 | Lukas et al. | 124/73 |
| 5,755,213 | A * | 5/1998 | Gardner et al. | 124/73 |
| 6,543,475 | B2 * | 4/2003 | Colby | 137/505.25 |
| 6,675,791 | B1 * | 1/2004 | Alexander et al. | 124/71 |
| 2002/0153057 | A1 * | 10/2002 | Nagel | 141/346 |
| 2004/0144803 | A1 * | 7/2004 | Baker | 222/147 |
| 2006/0249132 | A1 * | 11/2006 | Gabrel | 124/70 |
| 2008/0210210 | A1 * | 9/2008 | Colby | 124/73 |
| 2009/0229591 | A1 * | 9/2009 | Gabrel | 124/73 |
| 2009/0314380 | A1 * | 12/2009 | McKee | 141/2 |
| 2013/0269671 | A1 * | 10/2013 | Tseng | 124/74 |

* cited by examiner

*Primary Examiner* — Bret Hayes
*Assistant Examiner* — Derrick Morgan

(57) ABSTRACT

An air canister for an air cylinder including a valve is provided. The air canister includes an externally threaded head including an axial chamber and a first sealing ring put on a first groove; an internally threaded cap secured to the head; a spring biased sliding rod including an internal first passage, an internal second passage being blocked from the first passage and extending out of the head and the cap, a first port having a first end communicating with the first passage, and a second port having a first end communicating with the second passage; an externally threaded sleeve secured to both the head and the cap and including a second sealing ring put on an internal second groove, a third sealing ring put on an internal third groove, and a fourth sealing ring put on a fourth groove; and a C-ring clamped onto the sliding rod.

1 Claim, 8 Drawing Sheets

AIR CANISTER FOR AIR GUN

BACKGROUND OF THE INVENTION

1. Field of the Invention

The invention relates to air canisters for air gun and more particularly to such an air canister attached to an air cylinder mounted in a pistol grip of an air gun with improved characteristics.

2. Description of Related Art

A conventional air canister mechanism is provided in a pistol grip of an air gun. The air canister mechanism comprises a rack in the pistol grip and adapted to accommodate an air canister in connection with a plastic bullet supplying and firing system of the air gun, the rack having left and right finger holes; a bottom stop mounted in the rack; a biasing member mounted in the rack and supported on the stop; a push member secured to the biasing member and adapted to support the air canister in the rack, the push member having a threaded shank extending from a head and threaded into the biasing member, the head of the push member having bottom risers; an anti-skip disk mounted on the threaded shank and having a plurality of top recesses, the recesses engaging the risers and having a toothed portion on a bottom; and a spring member mounted on the push member and stopped between the biasing member and the anti-skip disk, the spring member having a top end engaged the toothed portion and a bottom end secured to the biasing member.

While the above identified air canister mechanism functions well, continuous improvements of the art are constantly sought.

SUMMARY OF THE INVENTION

It is therefore one object of the invention to provide an air canister for an air cylinder including a valve seat, a valve formed in the valve seat, a channel formed within the valve, a plurality of port members each having an end communicating with the channel, an annular groove formed on an inner end of the valve seat, and a sealing ring put on the annular groove to block the port members, comprising an externally threaded head including an axial chamber, an annular first groove, and a first sealing ring put on the first groove; an internally threaded cap secured to the externally threaded head; a spring biased sliding rod including an internal first passage, an internal second passage being blocked from the first passage and extending out of both the externally threaded head and the internally threaded cap, a first port having a first end communicating with the first passage and a second end terminating at an outer surface of the spring biased sliding rod, and a second port having a first end communicating with the second passage and a second end terminating at the outer surface of the spring biased sliding rod; an externally threaded sleeve secured to the internally threaded cap and including an annular second groove formed on an inner surface, a second sealing ring put on the second groove, an annular third groove formed on the inner surface of the externally threaded sleeve, a third sealing ring put on the third groove, an annular fourth groove formed on the inner surface of the externally threaded sleeve, and a fourth sealing ring put on the fourth groove; and a C-ring clamped onto the spring biased sliding rod to be spaced from the internally threaded cap; wherein in response to partially inserting the spring biased sliding rod into the valve to align the second passage with the channel and pushing the air canister toward the air cylinder until being stopped by the C-ring, the fourth sealing ring moves to pass the second port, thereby flowing compressed air to the port members via the first passage, the second passage, and the channel, and the compressed air is configured to enter the air cylinder by disengaging the sealing ring from the port members.

The above and other objects, features and advantages of the invention will become apparent from the following detailed description taken with the accompanying drawings.

DETAILED DESCRIPTION OF THE INVENTION

Figure 1:
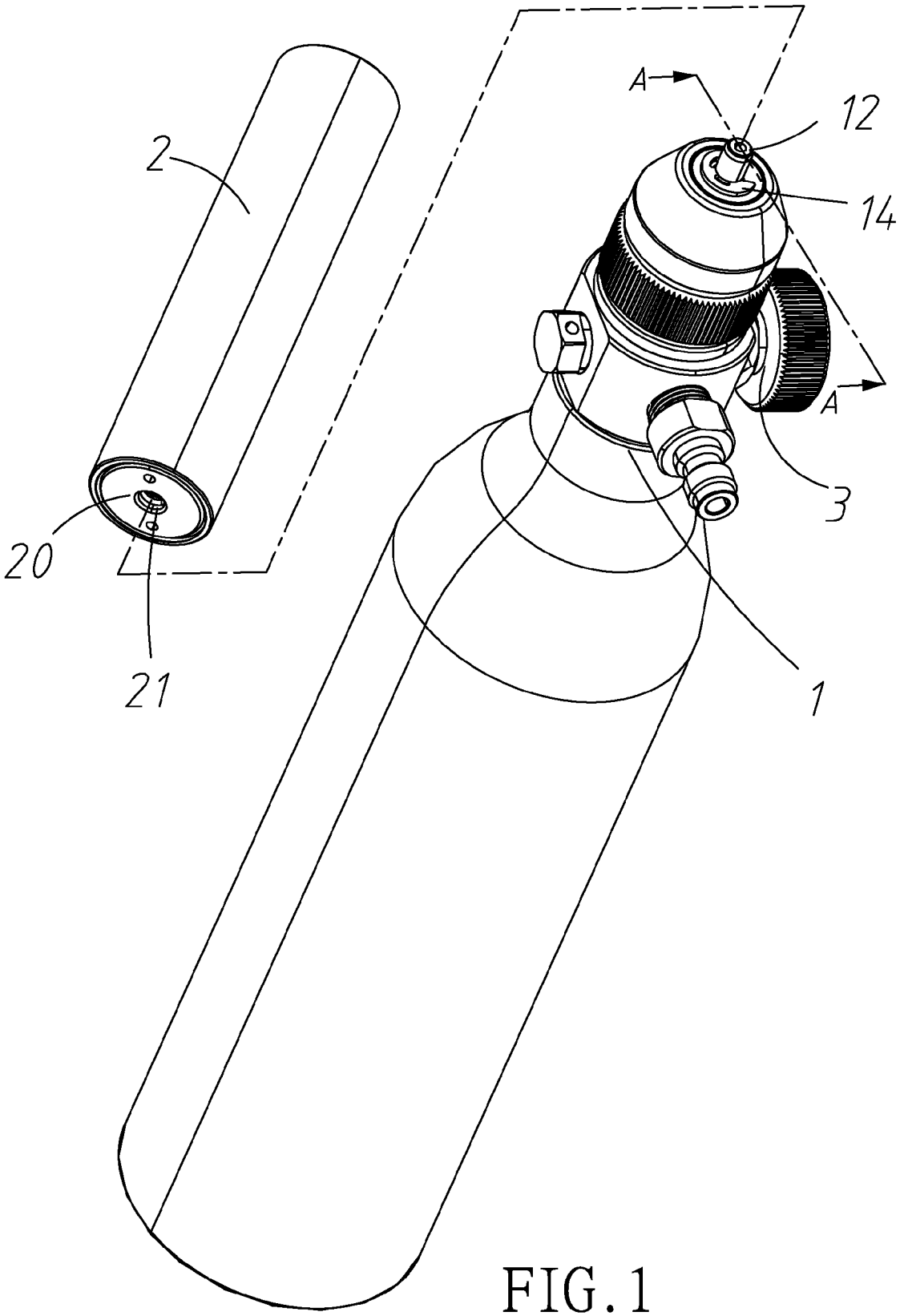
FIG. 1 is a perspective view of an air canister to be attached to an air cylinder of an air gun according to the invention.
Figure 2:
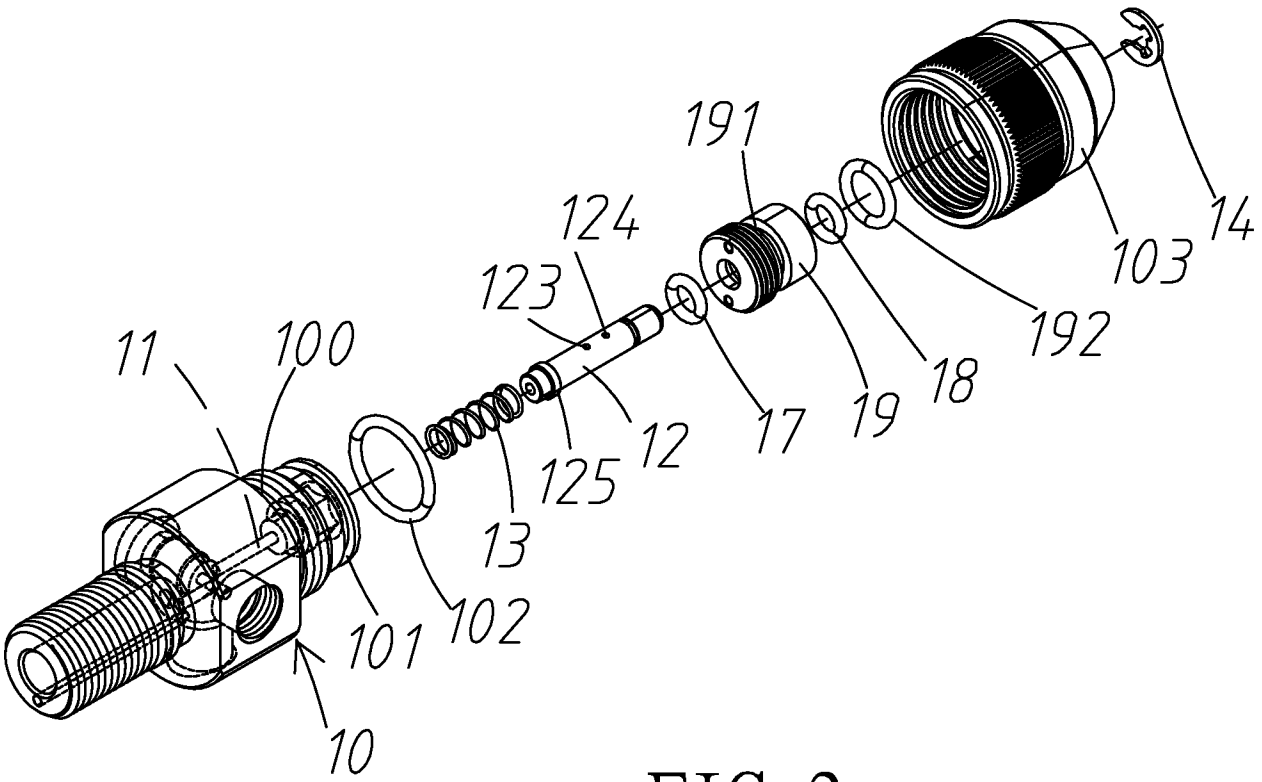
FIG. 2 is an exploded view of components at a head of the air canister.
Figure 2A:
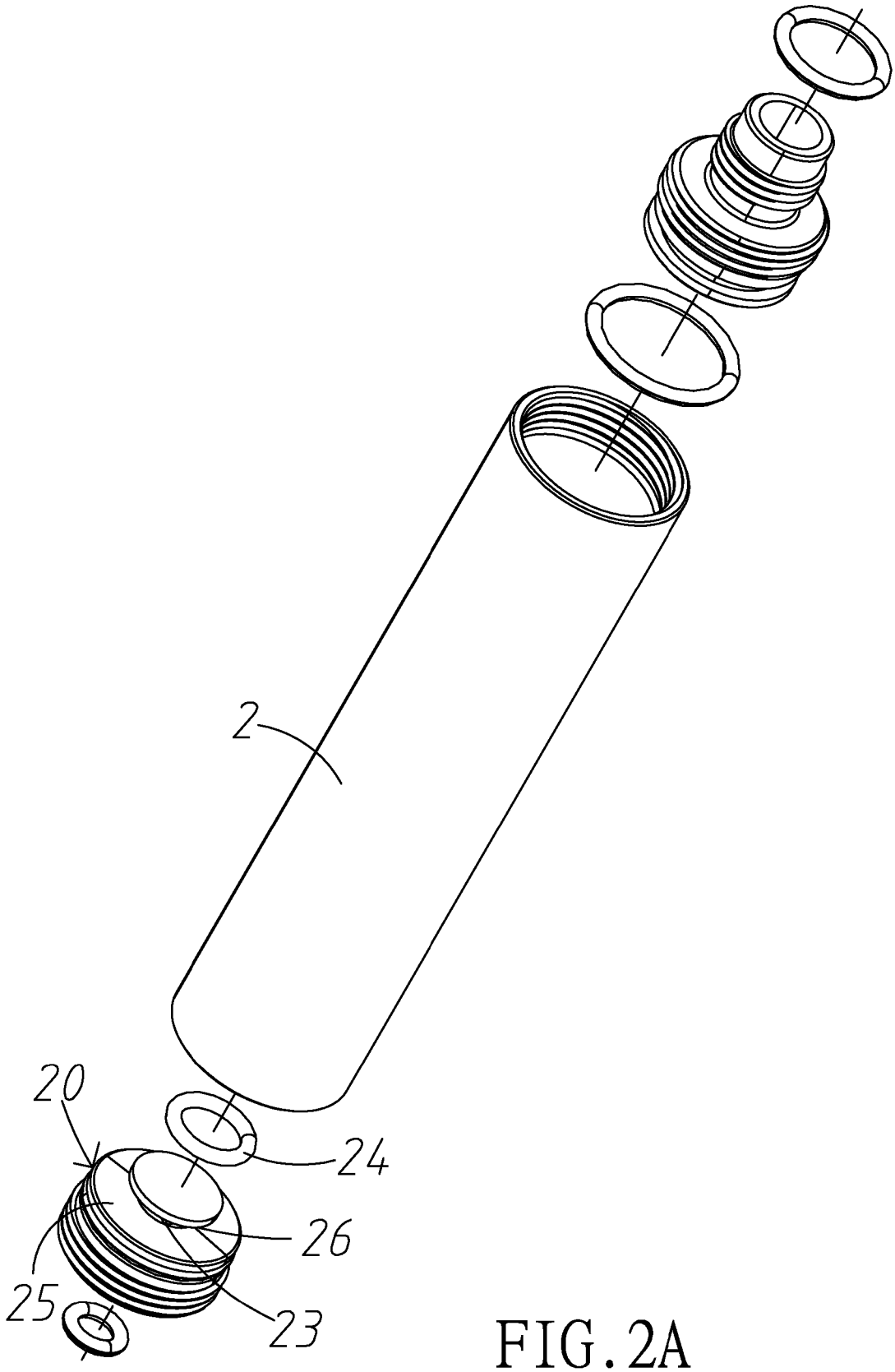
FIG. 2A is an exploded view of the air cylinder.
Figure 3:
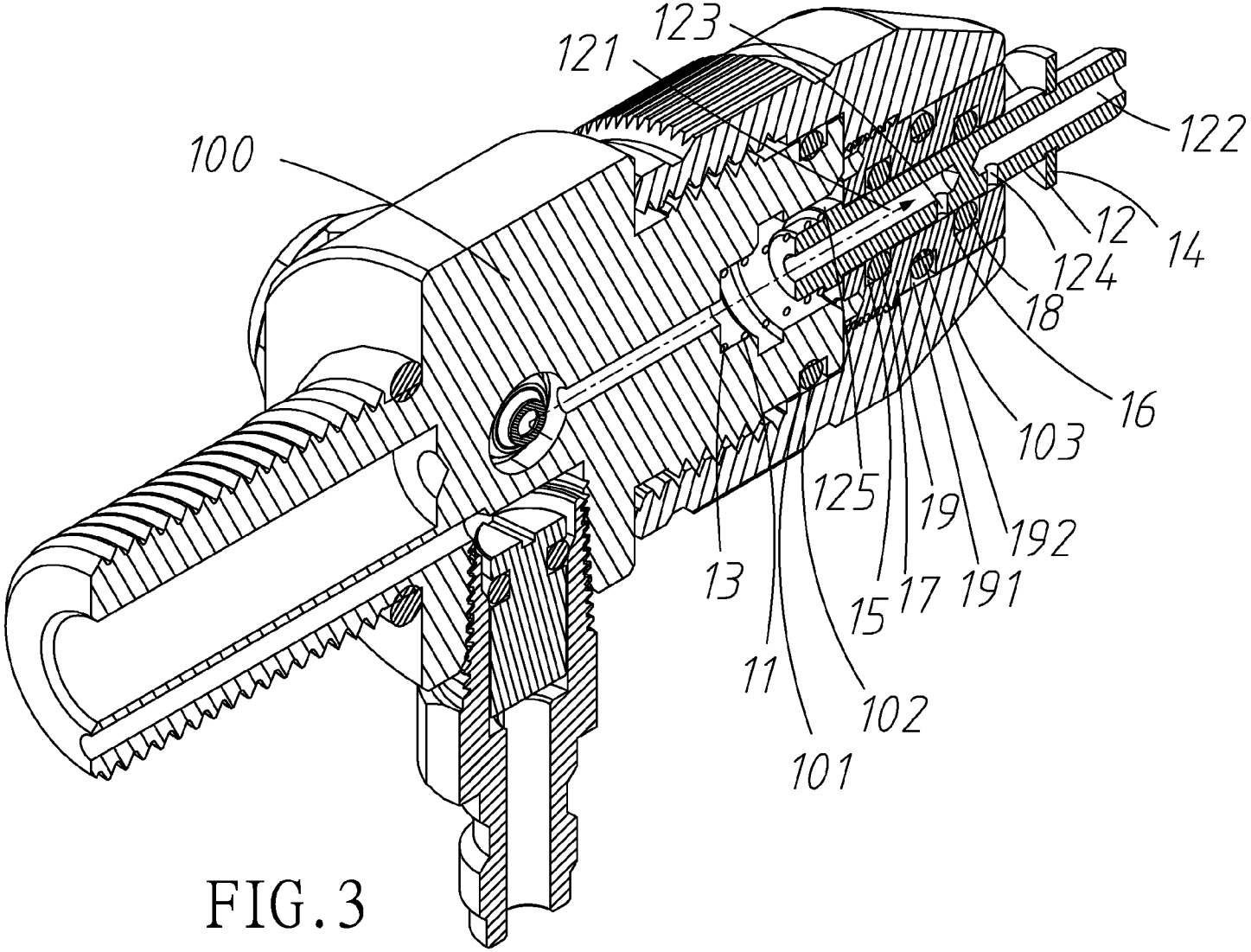
FIG. 3 is a sectional view taken along line A-A of FIG. 1.
Figure 4:
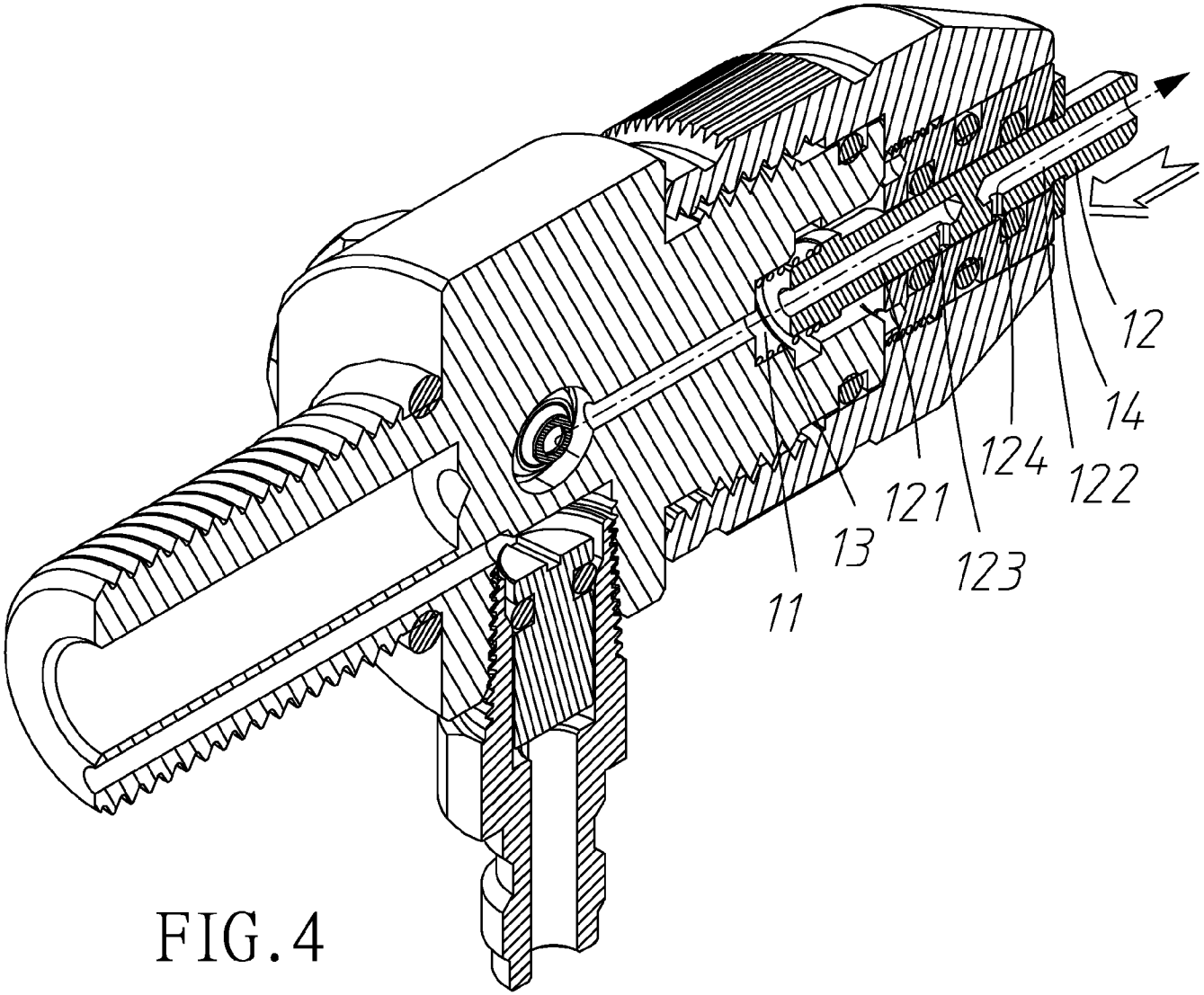
FIG. 4 is a view similar to FIG. 3 where the sliding rod moves rearward.
Figure 5:
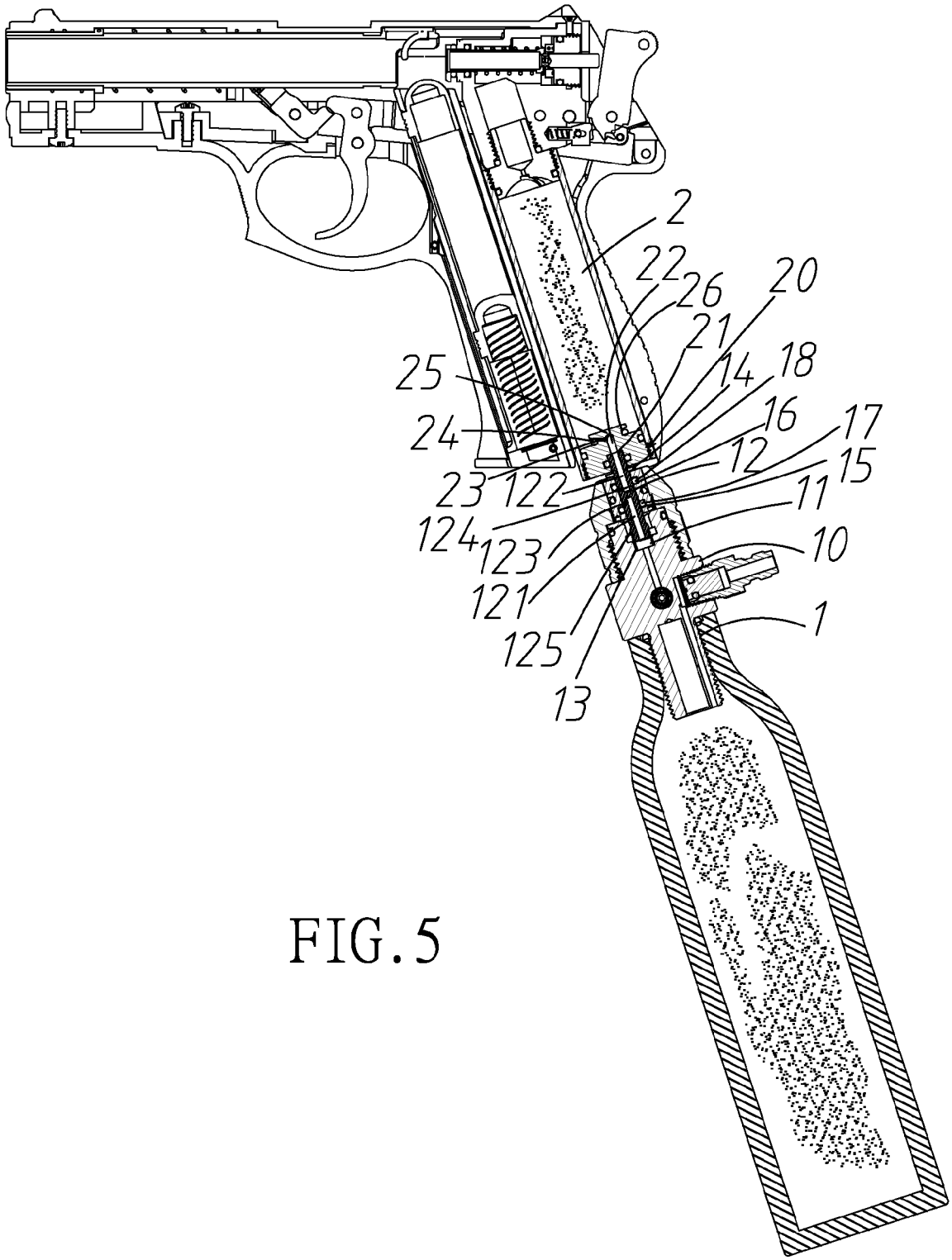
FIG. 5 is a longitudinal sectional view of the air canister attached to the air cylinder of an air gun for supplying compressed air to the air cylinder.
Figure 5A:
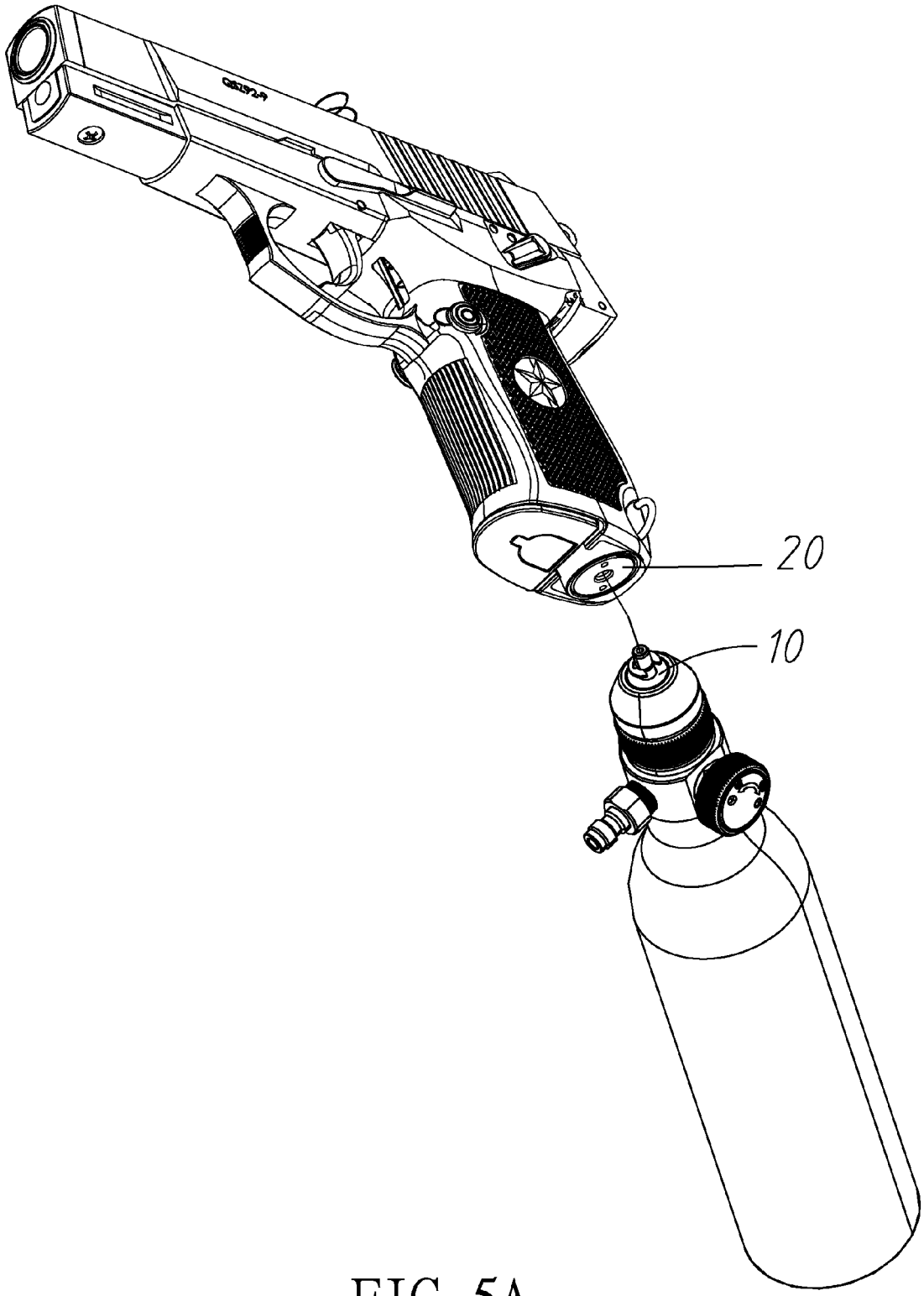
FIG. 5A is a perspective view of the air canister to be attached to the air cylinder of the air gun.
Figure 6:
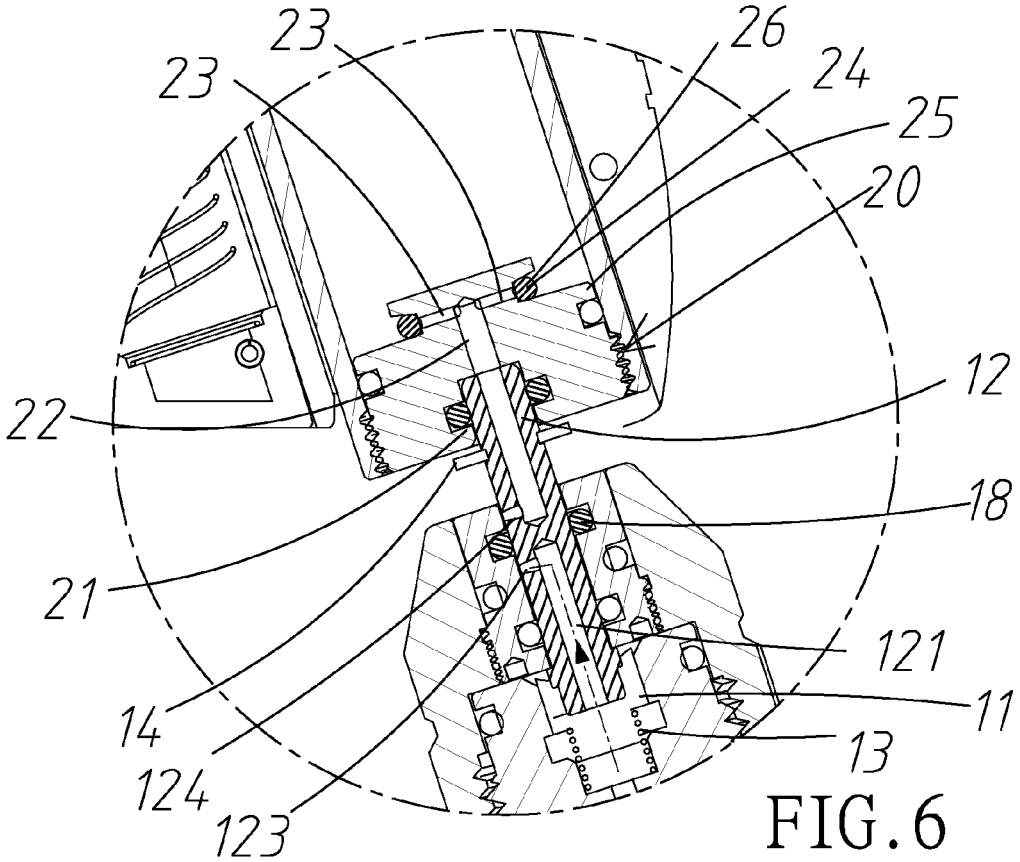
FIG. 6 is an enlarged view showing the air canister to be attached to the air cylinder.
Figure 7:
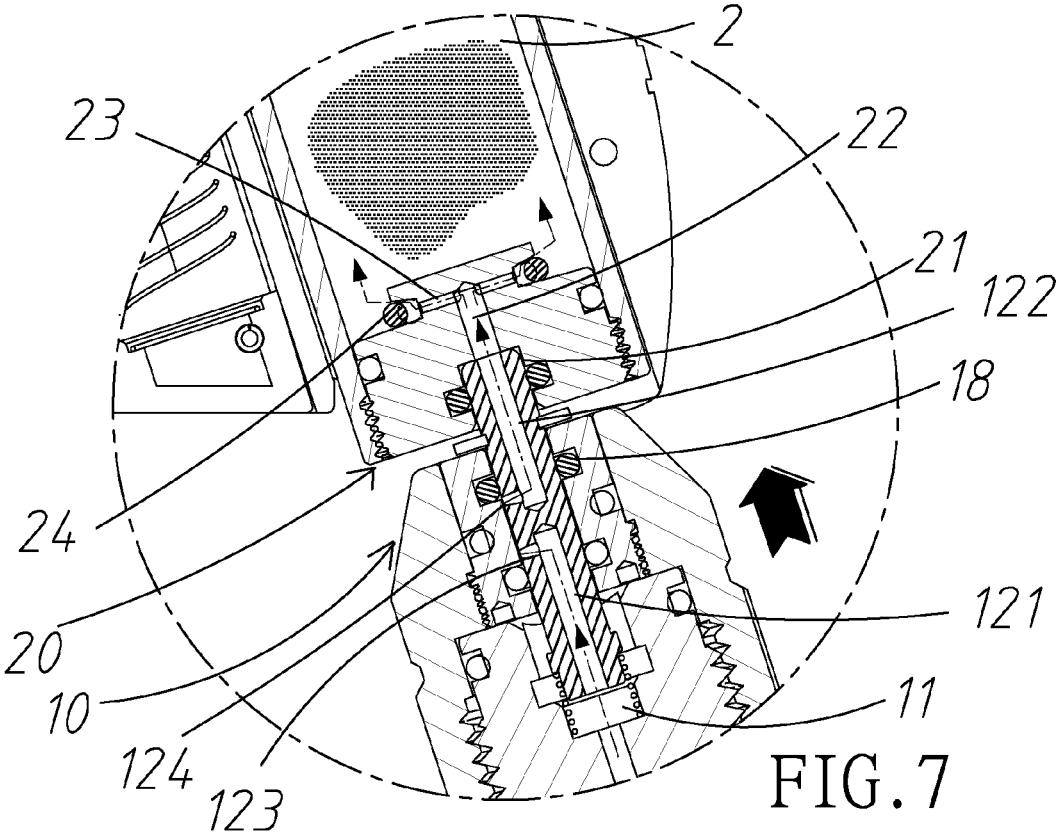
FIG. 7 is a view similar to FIG. 6 showing the air canister attached to the air cylinder for supplying compressed air thereto.

Referring to FIGS. 1 to 7, an air canister 1 for supplying compressed air to an air cylinder 2 of an air gun in accordance with the invention comprises the following components as discussed in detail below.

The air cylinder 2 includes a valve assembly 20 at one end. The valve assembly 20 includes a valve seat 25, a valve 21 at a center of the valve seat 25, a channel 22 within the valve 21, a plurality of ports 23 each having one end communicating with the channel 22, an annular groove 26 formed on an inner end of the valve seat 25, and a sealing ring 24 put on the groove 26 to block the other ends of the ports 23 when the air cylinder 2 and the air canister 1 are not attached to each other.

The air canister 1 includes a head assembly 10 having an externally threaded body 100, and an axial chamber 11 in the body 100. A pressure adjustment member 3 is secured to the body 100 and is adapted to communicate air with the chamber 11. The body 100 includes an annular groove 101 adjacent to a forward end, a sealing ring 102 put on the groove 101, and an internally threaded cap 103 secured to the body 100. The air canister 1 further includes a hollow sliding rod 12 having a first passage 121, a second passage 122 being forwardly of the first passage 121, blocked from the first passage 121, and extending forwardly out of both the body 100 and the cap 103, a first port 123 having one end communicating with the first passage 121 and a second end terminating at an outer surface of the sliding rod 12, a second port 124 having one end communicating with the second passage 122 and a second end terminating at the outer surface of the sliding rod 12, and an annular flange 125 formed on the outer surface proximate to the rear end of the sliding rod 12.

The air canister 1 further includes a torsion spring 13 having one end urged against the flange 125 and a second end anchored in a shoulder of the chamber 11. Thus, the sliding rod 12 is capable of sliding relative to the body 100. The air canister 1 further includes an externally threaded sleeve 19 having one end engaged the body 100. The sleeve 19 includes an annular groove 191, a sealing ring 192 put on the groove 191, an annular first groove 15 formed on an inner surface, an annular second groove 16 formed on the inner surface and being forwardly of the first groove 15, a first sealing ring 17 put on the first groove 15, and a second sealing ring 18 put on the second groove 16. A C-ring 14 is clamped onto a forward portion of the sliding rod 12.

In an inoperative position, the C-ring 14 is spaced from a forward end of the cap 103 and a flow path from the first passage 121 to the second passage 122 is blocked by the second sealing ring 18. Operation of supplying compressed air from the air canister 1 to the air cylinder 2 is described in detail below. A user may insert the forward portion of the sliding rod 2 into the valve 21 to align the second passage 122 with the channel 22. Next, the user may push the air canister 1 toward the air cylinder 2 by compressing the spring 13 until being stopped by the C-ring 14. Also, the second sealing ring 18 moves to pass the second port 124. Thus, the flow path is open and the compressed air can flow from the air canister 1 to the channel 22 via the flow path and the second passage 122. Further, the compressed air flows into the ports 23 to disengage the sealing ring 24 from the ports 23. As a result, the compressed air flows into the air cylinder 2 for storage. It is understood that a releasing of the pushing operation of the air canister 1 stops the flow path and returns to the inoperative position of the air canister 1.

While the invention has been described in terms of preferred embodiments, those skilled in the art will recognize that the invention can be practiced with modifications within the spirit and scope of the appended claims.

What is claimed is:

1. An air canister for an air cylinder including a valve seat, a valve formed in the valve seat, a channel formed within the valve, a plurality of port members each having an end communicating with the channel, an annular groove formed on an inner end of the valve seat, and a sealing ring put on the annular groove to block the port members, comprising, in combination:

an externally threaded head including an axial chamber, an annular first groove, and a first sealing ring put on the first groove;

an internally threaded cap secured to the externally threaded head; a spring biased sliding rod including an internal first passage, and an internal second passage blocked from the first passage, the sliding rod extending out of both the externally threaded head and the internally threaded cap, a first port having a first end communicating with the first passage and a second end terminating at an outer surface of the spring biased sliding rod, and a second port having a first end communicating with the second passage and a second end terminating at the outer surface of the spring biased sliding rod;

an externally threaded sleeve secured to both the externally threaded head and the internally threaded cap, the externally threaded sleeve including an annular second groove formed on an inner surface, a second sealing ring put on the second groove, an annular third groove formed on the inner surface of the externally threaded sleeve, a third sealing ring put on the third groove, an annular fourth groove formed on the inner surface of the externally threaded sleeve, and a fourth sealing ring put on the fourth groove; and a C-ring clamped onto the spring biased sliding rod to be spaced from the internally threaded cap;

wherein in response to partially inserting the spring biased sliding rod into the valve to align the second passage with the channel and pushing the air canister toward the air cylinder until being stopped by the C-ring, the fourth sealing ring passes the second port so that compressed air flows to the port members via the first passage, the second passage, and the channel, and the compressed air enters the air cylinder by disengaging the sealing ring from the port members.

* * * * *